US011148903B1

(12) United States Patent
Jordan et al.

(10) Patent No.: US 11,148,903 B1
(45) Date of Patent: Oct. 19, 2021

(54) SPOOL LIFTING APPARATUS

(71) Applicants: David S. Jordan, Knoxville, TN (US); Michael C. Jordan, Knoxville, TN (US); Scott M. Jordan, Knoxville, TN (US)

(72) Inventors: David S. Jordan, Knoxville, TN (US); Michael C. Jordan, Knoxville, TN (US); Scott M. Jordan, Knoxville, TN (US)

(73) Assignee: iTool Equipment Holding LLC, Clinton, TN (US)

( * ) Notice: Subject to any disclaimer, the term of this patent is extended or adjusted under 35 U.S.C. 154(b) by 0 days.

(21) Appl. No.: 16/602,741

(22) Filed: Dec. 2, 2019

(51) Int. Cl.
*B65H 55/00* (2006.01)

(52) U.S. Cl.
CPC ..... *B65H 55/00* (2013.01)

(58) Field of Classification Search
CPC ... B65H 55/00; B66F 9/06; B66F 9/18; Y10S 414/124
USPC ..... 414/607
See application file for complete search history.

(56) References Cited

U.S. PATENT DOCUMENTS 4,447,186 A * 5/1984 Renfro ..... B66F 9/18 414/589
4,688,981 A * 8/1987 Ravnsborg ..... B66F 9/12 414/607
9,624,077 B1 * 4/2017 Jordan ..... B66F 7/0625
10,752,276 B1 * 8/2020 Jordan ..... A47B 96/02

* cited by examiner

*Primary Examiner* — Saul Rodriguez
*Assistant Examiner* — Willie Berry, Jr.
(74) *Attorney, Agent, or Firm* — Michael E. McKee

(57) ABSTRACT

An apparatus enabling a barrel-including spool of windable material to be lifted and transported with a forklift truck includes two elongated channel members having open ends into which forks of a forklift truck can be directed and transversely-extending members for maintaining the channel members in a parallel relationship. A pair of hooks are pivotally suspended from the channel members and are capable of being hooked about end portions of an axle which is directed through the barrel of the spool. By directing the forks of a forklift truck into the open ends of the channel members, positioning the apparatus above the spool, and then hooking the hooks of the apparatus about the end portions of the axle which protrudes from the opposite sides of the spool, the spool can be lifted by way of the forklift truck.

16 Claims, 4 Drawing Sheets

SPOOL LIFTING APPARATUS

BACKGROUND OF THE INVENTION

This invention relates generally to means and methods for lifting a large item, such as a spool of cable or wire, from the floor and for transporting the item between two sites and relates, more particularly, to means and methods by which such an item can be lifted and transported with a forklift truck.

The class of liftable items with which this invention is concerned includes relatively large items, such as spools of cable or wire. Such spools commonly include a hollow barrel about which a length of coiled material, such as cable or wire, is wound and a pair of disc-like flanges disposed at the opposite ends of the barrel and thus on the opposite sides of the spool. Such spools can, in some instances, possess a flange-to-flange width of forty-eight inches, and this width is greater than the width to which a pair of forks of commonly-used forklift trucks can ordinarily be set. Consequently, efforts expended heretofore to lift such a large spool of cable or wire with a forklift truck have involved directing the forks beneath the spool of wound material and lifting the spool so that the forks bear directly against the wound material. Due to the weightiness of such a spool (with the cable or wire wound thereabout), the cable or wire which is positioned in engagement with the forks (and through which the weight of the spool is transferred to the forklift forks) could be damaged.

It would be desirable to provide a means with which a spool of the aforedescribed class can be lifted or transported with a forklift truck and which reduces the likelihood that the material which is wound about the spool will be damaged by the forks of the forklift truck used to lift or transport the spool.

Accordingly, it is an object of the present invention to provide a new and improved apparatus which facilitates the lifting and transporting of a spool of the aforedescribed class.

Another object of the present invention is to provide such an apparatus which accommodates the lifting of spools whose width (as measured between the sides of the spool) is greater than the spaced-apart width of the pair of forks of commonly-used forklift trucks.

Still another object of the present invention is to provide such an apparatus having size-adjustment features which enable the apparatus to be adapted for lifting and transporting spools having a width within a broad range of spool sizes.

Yet another object of the present invention is to provide such an apparatus which is uncomplicated in structure, yet effective in operation.

SUMMARY OF THE INVENTION

This invention resides in an apparatus enabling a spool to be lifted with a forklift truck wherein the spool has a barrel about which a windable material can be wound and two opposite sides, and wherein there is associated with the spool two elongated sections which protrude from the barrel of the spool and on opposite sides thereof.

The apparatus includes two elongated channel members wherein each of the elongated channel members includes a hollow interior having an opening at one end thereof and into which a fork of a forklift truck can be directed, and the two elongated channel members are fixed in a parallel relationship so that the two open ends of the channel members are in a condition for accepting a pair of forks of a forklift truck directed therein. In addition, the apparatus includes a pair of hooks wherein each hook is capable of being hooked about a corresponding one of the two elongated sections which protrude from the opposite sides of the barrel of the spool. Also provided are means for suspending the hooks from the two elongated channel members so that by directing the forks of a forklift truck into the open ends of the channel members, positioning the apparatus by way of the forklift truck above the spool to be lifted, and then hooking the hooks of the apparatus about the two elongated sections, the spool can be lifted with the forklift truck.

DETAILED DESCRIPTION OF AN ILLUSTRATIVE EMBODIMENT

Figure 1:
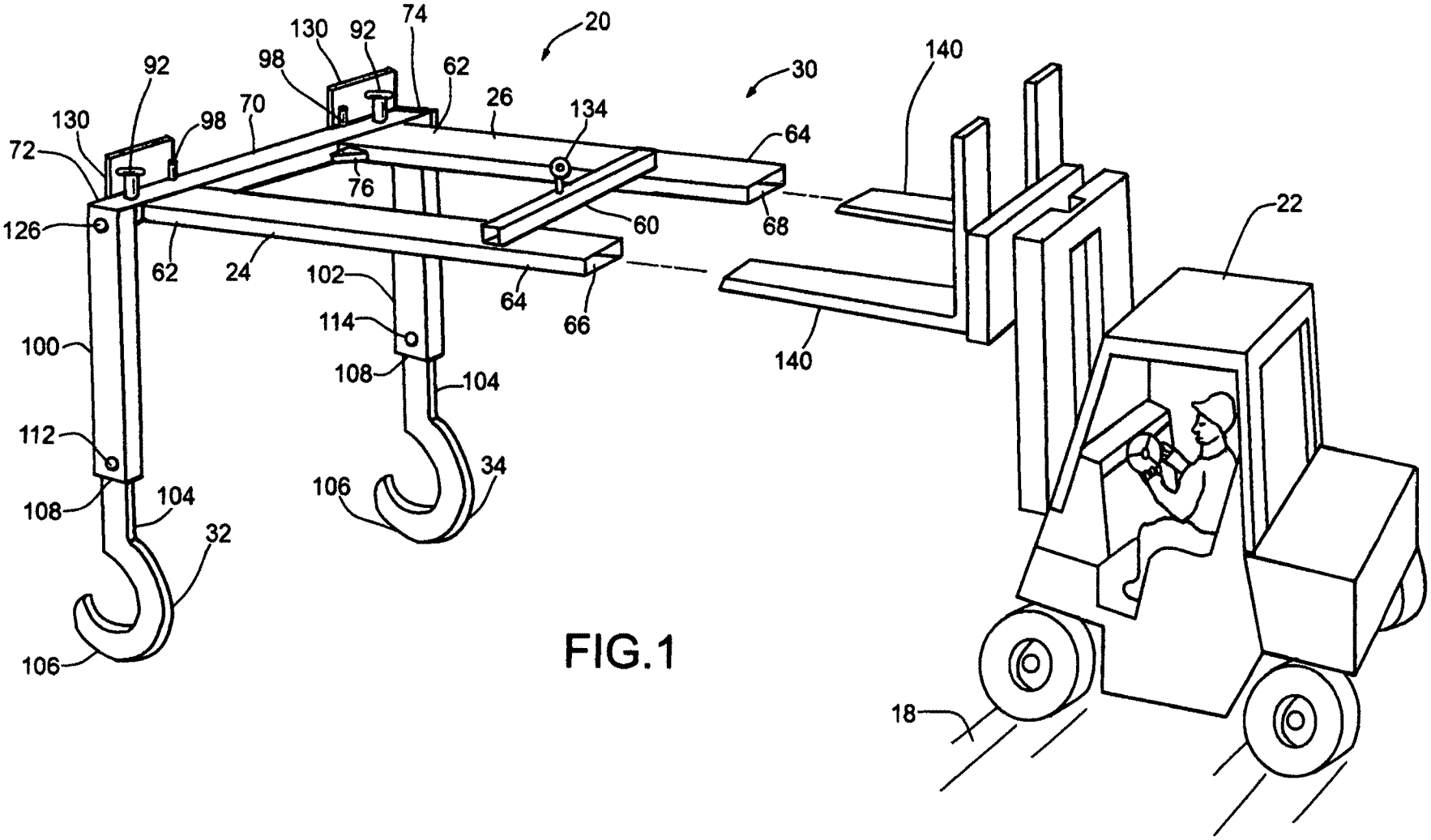
FIG. 1 is a perspective view of an embodiment of a spool lifting apparatus within which features of the present invention are embodied and a forklift truck with which the apparatus is capable of being used.

Turning now to the drawings in greater detail and considering first FIG. 1, there is shown an embodiment, generally indicated 20, of a spool lifting apparatus within which features of the present invention are incorporated and which is intended to be used to lift, by way of a forklift truck 22, a spool 40 (FIG. 7) of windable material from an underlying floor 18 for transport to an alternative site. Briefly, the apparatus 20 includes a pair of channel members 24, 26 which are fixedly arranged in parallel relationship with one another and framework, generally indicated 30, disposed at one end of the channel members 24, 26 from which a pair of hooks 32, 34 are suspended. In preparation of a lifting operation to be performed with the apparatus 20, the forks of a forklift truck 22 are accepted endwise by the open ends of the channel members 24, 26, and then the apparatus 20 is lifted from an underling floor 18 by way of the forklift truck 22 so that the hooks 32, 34 hang downwardly from the framework 30. Thereafter, the apparatus 20 is maneuvered by way of the forklift truck 20 to a position at which the framework 30 is disposed substantially vertically above the spool 40, and the hooks 32, 34 are joined, or hooked, to opposite sides of the spool 40 for subsequent lifting and transport with the forklift 22.

Figure 2:
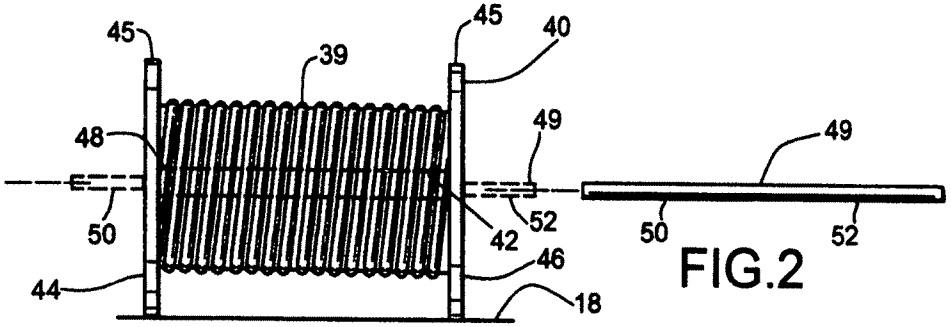
FIG. 2 is a front elevation view of an exemplary spool of windable material capable of being lifted with the FIG. 1 apparatus and forklift truck.

With reference to FIG. 2, there is depicted a spool 40 of the class with which this invention is intended to be used. Briefly, the spool 40 includes a centrally-disposed, hollow elongated barrel 42 about which a length of coiled material 39, such as electrical wire, steel cable, or rope or flexible sheet material, such as flexible flooring material, is wound and includes a pair of disc-like flanges 44, 46 attached to the opposite ends of the barrel 42 on the opposite sides of the spool 40. Each flange 44 or 46 is circular in form and defines a cylindrical rim 45 along its peripheral edge. Furthermore, there is commonly provided a bore 48 which extends through the center of both flanges 44, 46 and the elongated barrel 42.

As will be apparent herein and to enable the spool 40 to be supported by the hooks 32, 34 of the apparatus 20, an axle rod 49 is directed through the bore 48 of the spool 40 so as to provide end portions, described herein, which protrude axially from the opposite sides of the spool 40, and it is these protruding end portions which are capable of being hooked by the hooks 32, 34 of the apparatus 20 for a lifting and transporting operation. In particular and with reference to FIG. 2 wherein the axle rod 49 is shown to be movable between a solid-line condition disposed to one side of the spool 40 and a phantom-line condition disposed through the spool barrel 42 at which end portions, indicated 50 and 52, of the axle 49 protrude away from the opposite sides of the spool 40 and are disposed outboard of the spool flanges 44, 46.

With reference to FIGS. 1 and 3-5, each channel member 24 or 26 includes two opposite forward and rearward ends 62 and 64, respectively, and has a transverse cross section which is substantially rectangular in form. For accepting the fork of a forklift truck 22, the rearward end 64 of each channel member 24 or 26 defines an opening 66 or 68 of substantially rectangular shape.

To aid in the securement of the channel members 24, 26 in a fixed, substantially parallel relationship, the apparatus framework 30 includes an elongated strut 60 which extends transversely of, or across, the channel members 24, 26 adjacent the rearward end 64 thereof and has ends which are affixed (e.g. welded) to (the upper face of) the channel members 24, 26. In addition, the framework 30 includes members, described herein, which further aid to hold the channel members 24, 26 in a fixed, parallel relationship.

Figure 3:
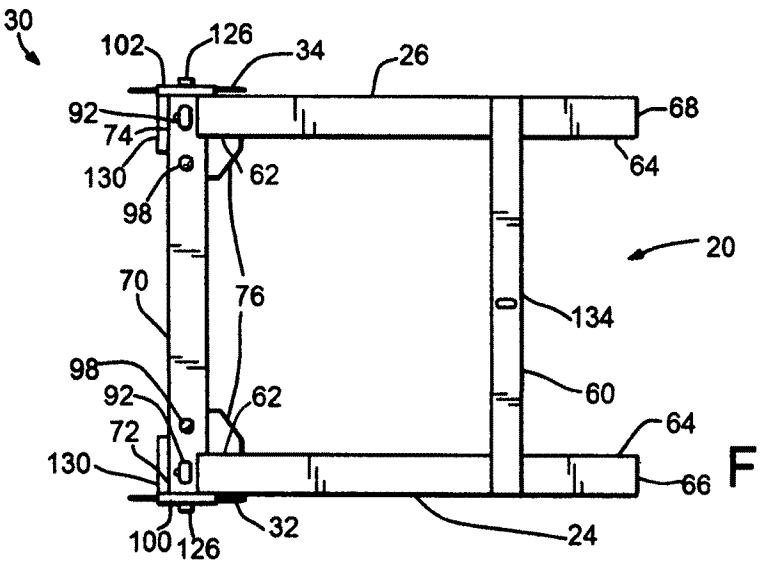
FIG. 3 is a plan view of the FIG. 1 apparatus as seen generally from above in FIG. 1.
Figure 5:
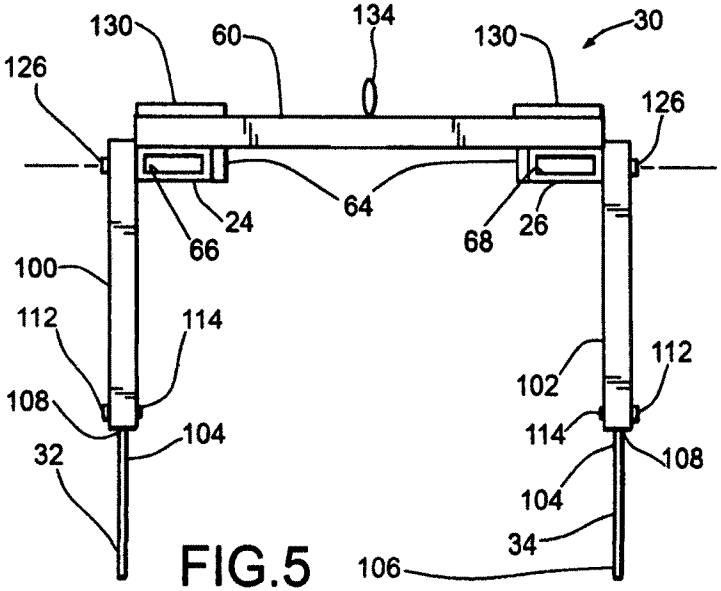
FIG. 5 is an end elevation view of the FIG. 1 apparatus as seen from the right in FIG. 4.
Figure 4:
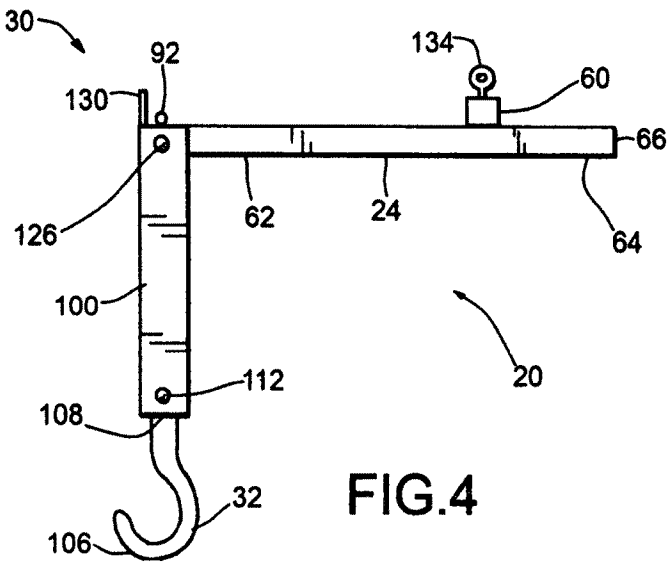
FIG. 4 is a side elevation view of the FIG. 1 apparatus as seen from below in FIG. 3.

More specifically and with reference to FIGS. 3-5, the framework 30 also includes an elongated hollow member 70 which extends transversely of the channel members 24, 26 and whose opposite ends, indicated 72 and 74, are fixedly joined (e.g. welded) across the forward ends 62 of the channel members 24, 26. To help brace the channel members 24, 26 in the parallel relationship, the apparatus 20 also includes a pair of plate-like, somewhat triangular brace members 76 whose edges are joined, or welded, between the elongated hollow member 70 and an adjacent (side of a) channel member 24 or 26.

The framework 30 also includes altering means, generally indicated 80, which enables the spaced-apart distance between the hooks 32, 34 to be altered and to thereby enable the hooks 32, 34 to be connected to, or used with, spools having a width (i.e. a width as measured between the side flanges of the spool) within a relative broad range of spool widths. To this end, the means 80 includes a pair of elongated tube sections 82 and 84 which are each positioned within a corresponding end 72 or 74 of the elongated hollow member 70 and which can be telescopically (and slidably) shifted in position relative to and along the length of the member 70 so that the outermost end, indicated 73 or 75 in FIG. 6, can be shifted laterally in position with respect to the channel members 24, 26. Moreover, each of the channel members 24, 26 includes a vertically-opening opening 88 adjacent the forward end 62 of the channel member 24 or 26, and each of the tube sections 82 or 84 includes a series of vertically-opening openings 90 which extend along the length of the tube section 82 or 84. It follows that by telescopically shifting the tube sections 82 or 84 along the length of the member 70 so that a selected one of the openings 90 is positioned in vertically-aligned registry with the opening 88 defined in the corresponding channel member 24 or 26, and then directing the shank of a pin 92 can thereafter directed through the aligned openings 88, 90 to secure each tube section 82 or 84 along the length of the elongated member 70.

Figure 6:
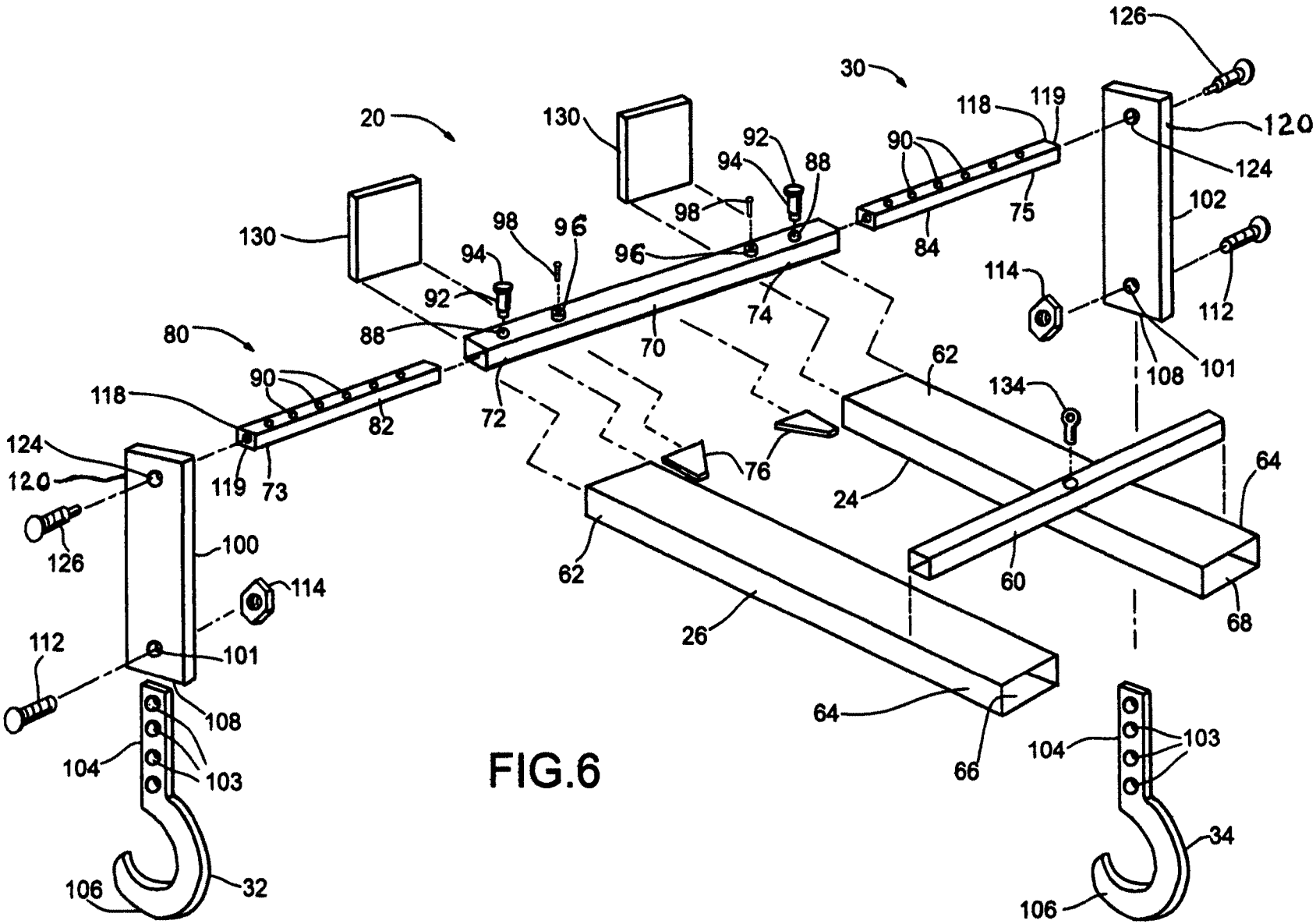
FIG. 6 is a perspective view of the FIG. 1 assembly, shown exploded.

With reference still to FIG. 6, the pin 92 could be a spring-biased pin whose shank is contained within a cylindrical housing 94. Moreover and if desired, a pair of nuts 96 can be welded atop the elongated member 70 (at located disposed inboard of the pins 92) and in vertical alignment with a preformed opening formed within the member 70. These nuts 96 threadably accept the shanks of bolts 98 directed therein, and each of these bolts 98 is capable of being tightened against the upper surface of a corresponding one of the tube sections 82, 84 to provide a secondary means for securing the tube section 82 or 84 in a fixed position along the length of the elongated member 70.

In addition, the framework 30 includes channel members 100 and 102 for suspending the hooks 32, 34 from the outermost ends 73, 75 of the tube sections 82 or 84. In this connection, each hook 32 or 34 is somewhat plate-like in form having a shank portion 104 and a hook portion 106 which are arranged substantially in a plane, and each channel member 100 or 102 includes a downwardly-opening end opening 108 within which the shank portion 104 of each hook 32 or 34 is positioned. To accommodate an adjustment in position of the hooks 32, 34 along the lengths of the channel members 100, 102, each channel member 10 or 102 includes a through-opening 101 adjacent one (i.e. the lower) end thereof, and the shank portion 104 of each hook 32 or 34 includes a series of openings 103 which extend along the length of the shank portion 104. By positioning the hooks 32, 34 along the length of its corresponding channel member 100 or 102 so that a selected one of the openings 103 is aligned with the through-opening 101, and then directing the shank of a bolt 112 through the aligned openings 101, 103, the hook 32 or 34 is secured at a fixed location along the length of the channel member 100 or 102. The bolt 112, in turn, is securable through the aligned openings 101, 103 with a nut 114.

To adjust the position of each hook 32 or 34 along the length of a corresponding channel member 100 or 102, the bolt 112 is removed from the aligned openings 101, 103, and then the hook 32 or 34 is shifted in position (e.g. upwardly or downwardly) along the length of the corresponding channel member 100 or 102 so that an alternative one of the openings 103 is aligned with the opening 101 of the channel member 100 or 102. At that point, the bolt 112 is re-inserted through the aligned openings 103, 101 to secure the hook 32 or 34 at an alternative location along the length of the channel member 100 or 102. As will be apparent herein, the capacity to adjust the position of the hooks 32, 34 along the length of the channel members 100, 102—and thus the vertically-spaced distance between the hook portion 106 of the hooks 32, 34 from the channel members 100, 102 permits the apparatus 20 to be positioned above the spool having a diameter (corresponding with the diameter of the flanges of the spool) within a broad range of diameters.

In addition, it is a feature of the apparatus 20 that the hooks 32, 34 (along with the channel members 100, 102) are free to be pivoted (in fore and aft directions) relative to the tube sections 82, 84 from which the hooks 32, 34 are suspended. To this end, there is provided a stud 118 which is fixedly secured (e.g. welded within) the outboard end 73 or 75 of each tube section 82 or 84, and each stud member 118 includes an internally-threaded opening 119 whose longitudinal axis extends along the longitudinal axis of the corresponding tube section 82 or 84. Meanwhile, the (upper) end, indicated 120, of each channel member 100 or 102 includes a laterally-opening opening 124 which extends therethrough, and each channel member 100 or 102 is pivotally secured to a corresponding outermost end 73 or 75 of a corresponding tube section 82 or 84 with a shoulder bolt 126 whose shoulder extends through the opening 124 and whose threaded end is tightened within the threaded opening 119 of the stud 118. It follows that with the channel members 100, 102 thereby pinned to the tube sections 82, 84 by way of the bolts 126, the hooks 32, 34 are free to pivot forwardly and rearwardly about the bolts 126 relative to the tube sections 82, 84. This capacity of the hooks 32, 34 to pivot relative to the tube sections 82, 84 facilitates the hooking of the hooks 32, 34 about an axle rod 49 (FIG. 2) which extends through a spool 40 when preparing the apparatus 20 to lift the spool 40 and enables the hooks 32, 34 of the apparatus 20 to be pivoted to a position disposed alongside the channel members 24, 26 when folding the apparatus 20 to a relatively compact condition for storage.

Figure 7:
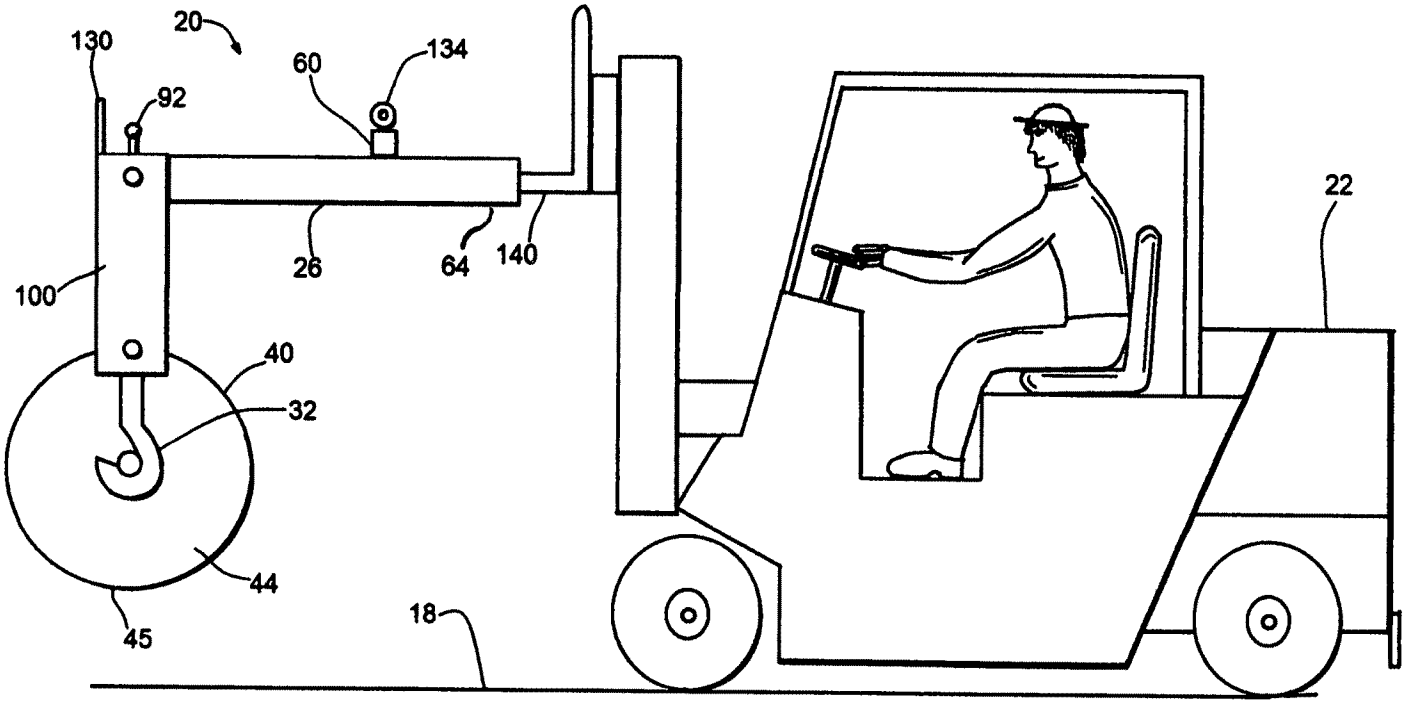
FIG. 7 is a side elevation view of the FIG. 1 assembly being used with a forklift truck to lift and support a spool of windable material.

With reference to FIGS. 1 and 7 and in order to use the apparatus 20 to lift a spool 40 from the underlying floor 18 and transport the spool 40 to an alternative site, the forklift truck 22 is driven forwardly toward the rearward ends 64, 64 of the channel members 24, 26 so that the two forks, indicated 140, of the forklift truck 22 are accepted by the openings 66, 68 provided at the rearward ends 64, 64 of the channel members 24, 26. In practice and before the forks 140 of the forklift truck 22 are directed into the ends 64, 64 of the channel members 24, 26, the channel members 24, 26 are likely to be laying flat upon the floor 18. This being the case, the forks 140 of the forklift truck 22 are likely to be positioned in a lowered condition (i.e. spaced close to the floor 18) as the forklift truck 22 moves forwardly toward the openings 66, 68 of the channel members 24, 26. It also follows from the foregoing that in order for the forks 140, 140 to be simultaneously accepted by the openings 66, 68 of the channel members 24, 26, the spaced-apart distance between the center of the openings 66, 68 closely approximates the spaced-apart distance between the longitudinal axes of the forks 140, 140.

Once the forks 140, 140 have been fully accepted by the openings 66, 68 of the channel members 24, 26, the apparatus 20 can be lifted from the floor 18, and the spaced-apart distance between the hooks 32, 34 is adjusted, as necessary, so that the hooks 32, 34 will be disposed on opposite sides of the spool 40 when the channel members 24, 26 are moved to an elevated, substantially vertically-disposed position above the spool 40. As discussed earlier, the spaced-apart distance between the hooks 32, 34 is adjusted by shifting the tube sections 82, 84 longitudinal relative to and along the length of the elongated member 70.

With the channel members 24, 26 lifted to a height which exceeds the height of the spool 40 (which height extends the diameter of the flanges 44 of the spool 40), the forklift truck 22 approaches the front of the spool 40 so that the longitudinal centerline of the apparatus 20 (which centerline extends midway between the channel members 24, 26) is substantially aligned with the radial midplane of the spool 40. The advancement of the apparatus 20 toward the spool 40 is halted when the elongated member 70 is disposed in substantially vertical registry with the axle rod 49 extending through the barrel 42 of the spool 40. At that point, the hook portion 106 of each of the hooks 32, 34 is manipulated about a corresponding end portion 50 or 52 of the axle rod 49 which extends through the barrel 42 of the spool 40. As mentioned earlier, the distance between each hook portion 106 and the corresponding tube section 82, 84 from which it extends can be adjusted by longitudinally shifting the shank 104 of the hook 32 or 34 relative to the channel member 102 to which the hook 32 or 34 is securable. With the hooks 32, 34 thus secured about the end portions 50, 52 of the axle rod 49, the spool 40 can be lifted with the forklift truck 22 by raising the forks 140 an additional amount. Of course, with the spool 40 raised above the floor 18, it can be transported with the forklift truck 22 to an alternative site.

It will be understood that numerous modifications and substitutions can be had to the aforedescribed embodiment 20 without departing from the spirit of the invention. For example, the aforedescribed embodiment 20 can be provided with a pair of floor-engagable foot plates 130 (best shown in FIG. 6) which are secured to the forwardly-facing side of the elongated member 70 to permit the channel members 24, 26 to be supported (e.g. during storage) in an upright, substantially vertical orientation. In addition, an eyelet 134 (FIG. 6) can be fixedly secured (as with welds) atop the strut 60 at a location disposed substantially midway along the length thereof to facilitate the securement, or suspension, of the apparatus 20 with a chain (not shown). In other words, the eyelet 134 accommodates the attachment of a chain to the apparatus 20 for suspension, and subsequent manipulation of the apparatus 20 about a spool 40, by way of the chain.

Accordingly, the aforedescribed embodiment 20 is intended for the purpose of illustration and not as limitation.

The invention claimed is:

1. An apparatus enabling a spool to be lifted with a forklift truck wherein the spool has a barrel about which a windable material can be wound and two opposite sides and wherein there is associated with the spool two elongated sections which protrude from the barrel of the spool and on opposite sides thereof; the apparatus comprising:

two elongated channel members wherein each of the elongated channel members includes a hollow interior having an opening at one end thereof and into which a fork of a forklift truck can be directed, and the two elongated channel members are fixed in a parallel relationship with one another and at a fixed distance apart so that the two open ends of the channel members are in a condition for accepting a pair of forks of a forklift truck directed endwise therein;

a pair of hooks wherein each hook is capable of being hooked about a corresponding one of the two elongated sections which protrude from the barrel of the spool; and means for suspending the hooks from the two elongated channel members so that when the two channel members are lifted by a pair of forks of a forklift truck accepted by the open ends of the two channel member, the hooks are disposed beneath the horizontal level of the two channel members so that by directing the forks of a forklift truck into the open ends of the channel members, positioning the apparatus by way of the forklift truck above the spool to be lifted, and then hooking the hooks of the apparatus about the two elongated sections, the center of gravity of the spool is disposed beneath the horizontal level of the two channel members and the spool can be lifted with the forklift truck;

wherein the apparatus further includes adjustment means interposed between the two elongated channel members and the hooks for adjusting the spaced-apart distance between the pair of hooks independently of the positional relationship between the two elongated channel members; and wherein the adjustment means includes a telescoping arrangement of members which extend outboard of the two elongated channel members so that by altering the lengthwise position of the telescoping arrangement of members relative to one another, the spaced-apart distance between the two hooks is altered.

2. The apparatus as defined in claim 1 wherein the telescoping arrangement of members includes a transversely-extending elongated hollow member which is joined to so as to extend transversely of the two elongated channel members and has two opposite ends which open outwardly of the sides of the apparatus and further includes two inner elongated members wherein each inner elongated member is positioned within a corresponding open end of the transversely-extending elongated hollow member for movement relative to and along the length thereof and includes an outermost end from which a corresponding hook is suspended so that by altering the position of at least one of the inner elongated members relative to and along the length of the transversely-extending elongated hollow member, the spaced-apart distance between the two hooks is altered.

3. The apparatus as defined in claim 2 further including means for releasably securing each of the inner elongated members in a fixed position along the length of the transversely-extending elongated hollow member.

4. The apparatus as defined in claim 2 wherein each of the two inner elongated members includes an outermost end which extends from a corresponding open end of the transversely-extending elongated member within which the inner elongated member is positioned, and each hook is suspended from the outermost end of a corresponding one of the inner elongated members.

5. The apparatus as defined in claim 1 wherein each of the pair of hooks is attached to the two elongated channel members to accommodate pivotal movement relative thereto.

6. The apparatus as defined in claim 1 wherein the hooks are spaced laterally from an end of the two elongated channel members by a preselected distance, and the adjustment means includes means for adjusting the preselected distance.

7. The apparatus as defined in claim 1 wherein the means for suspending includes a pair of suspension members wherein each suspension member has two opposite ends and is joined at one of its opposite ends of the two elongated channel members, and each hook of the pair of hooks is joined to the other end of a corresponding one of the suspension members, and the apparatus includes means for adjusting the position of the hook along the length of the corresponding suspension member to which the hook is joined.

8. The apparatus as defined in claim 7 wherein each suspension member is in the form of a channel having an open end, and each hook includes a shank portion which is slidably accepted within the open end of a corresponding one of the suspension members, and the means for adjusting includes means for securing the shank portion of each hook at alternative positions along the length of the corresponding suspension member.

9. The apparatus as defined in claim 8 wherein each suspension member defines a through-opening and the shank portion of each hook defines a series of openings therealong, and each shank portion is positionable along the length of the suspension member so that each opening in the series of openings can be aligned with the through-opening defined in the corresponding suspension member.

10. An apparatus enabling a spool to be lifted with the forks of a forklift truck whereas the spool has a barrel about which a windable material can be wound or from which a windable material can be unwound and two opposite sides and wherein there is associated with the spool two elongated sections which extend axially from the barrel of the spool and on opposite sides thereof; the apparatus comprising:

two elongated channels wherein each of the elongated channels includes a hollow interior having an opening at one end thereof and into which a fork of a forklift truck can be directed endwise;

framework for maintaining the two elongated channels in a parallel relationship with one another and at a fixed distance apart and so that the elongated channels extend forwardly and rearwardly of the apparatus so that the two open ends of the two elongated channels are in a condition for accepting a pair of forks of a forklift truck;

a pair of hooks wherein each hook is capable of being hooked about a corresponding one of the two elongated sections which extend axially from the barrel of the spool; and means for suspending each of the hooks from the framework so that when the two elongated channel members are lifted by a pair of forks of a forklift truck accepted by the open ends of the channel members, the hooks are disposed beneath the horizontal level of the two channel members and on opposite sides of the apparatus for pivotal movement of the hooks relative to the framework in fore and aft directions so that by directing the forks of a forklift truck into the open ends of the elongated channel members, lifting the apparatus by way of the forklift truck into a position above the spool to be lifted so that the hooks are disposed substantially in vertical registry with the barrel of the spool, and then hooking the hooks of the apparatus about the elongated sections, the center of gravity of the spool is disposed beneath the horizontal level of the two elongated channel members and the spool can be lifted by way of the forklift truck;

wherein the apparatus further includes adjustment means interposed between the two elongated channel members and the hooks for adjusting the spaced-apart distance between the pair of hooks independently of the positional relationship between the two elongated channel members; and wherein the adjustment means includes a telescoping arrangement of members which extend outboard of the two elongated channel members so that by altering the lengthwise position of the telescoping arrangement of members relative to one another, the spaced-apart distance between the two hooks is altered.

11. The apparatus as defined in claim 10 wherein the telescoping arrangement of members includes a transversely-extending elongated hollow member which is joined to so as to extend transversely of the two elongated channel members and has two opposite ends which open outwardly of the sides of the apparatus and further includes two inner elongated members wherein each inner elongated member is positioned within a corresponding open end of the transversely-extending elongated hollow member for movement relative to and along the length thereof and includes an outermost end from which a corresponding hook is suspended so that by altering the position of at least one of the inner elongated members relative to and along the length of the transversely-extending elongated hollow member, the spaced-apart distance between the two hooks is altered.

12. The apparatus as defined in claim 11 further including means for releasably securing each of the inner elongated members in a fixed position along the length of the transversely-extending elongated hollow member.

13. The apparatus as defined in claim 11 wherein each of the two inner elongated members includes an outermost end which extends from a corresponding open end of the transversely-extending elongated member within which the inner elongated member is positioned, and each hook is suspended from the outermost end of a corresponding one of the inner elongated members.

14. The apparatus as defined in claim 10 wherein the hooks are spaced laterally from an end of the two elongated channel members by a preselected distance, and the adjustment means includes means for adjusting the preselected distance.

15. The apparatus as defined in claim 10 wherein the means for suspending includes a pair of suspension members wherein each suspension member has two opposite ends and is joined at one of its opposite ends of the two elongated channel members, and each hook of the pair of hooks is joined to the other end of a corresponding one of the suspension members, and the apparatus includes means for adjusting the position of the each hook along the length of the corresponding suspension member to which the hook is joined.

16. The apparatus as defined in claim 15 wherein each suspension member is in the form of a channel having an open end, and each hook includes a shank portion which is slidably accepted within the open end of a corresponding one of the suspension members, and the means for adjusting includes means for securing the shank portion of each hook at alternative positions along the length of the corresponding suspension member.

* * * * *